United States Patent [19]

Dijksman

[11] Patent Number: 4,830,191

[45] Date of Patent: May 16, 1989

[54] INTERMEDIATE BULK CONTAINERS

[75] Inventor: Alan M. Dijksman, Cleveland, England

[73] Assignee: Imperial Chemical Industries PLC, London, England

[21] Appl. No.: 236,284

[22] Filed: Aug. 24, 1988

Related U.S. Application Data

[63] Continuation of Ser. No. 496,214, May 19, 1983, abandoned.

[30] Foreign Application Priority Data

Nov. 26, 1981 [GB] United Kingdom ..... 8135431
Jul. 7, 1982 [GB] United Kingdom ..... 8219485

[51] Int. Cl.[4] ..... B65D 90/16

[52] U.S. Cl. ..... 206/599; 206/386; 206/600; 206/821

[58] Field of Search ..... 206/386, 503, 821

[56] References Cited

U.S. PATENT DOCUMENTS

| | | | |
|---|---|---|---|
| 658,147 | 9/1900 | Herriott | 383/2 |
| 1,767,274 | 6/1930 | Broderick | 383/2 |
| 2,698,696 | 1/1955 | Strong . | |
| 2,751,140 | 6/1956 | Brady | 383/35 |
| 2,913,205 | 11/1959 | Desbois | 206/598 |
| 3,282,621 | 11/1966 | Peterson | 206/386 |
| 3,337,036 | 8/1967 | Peterson | 206/598 |
| 3,477,631 | 11/1969 | Dunlap, Jr., et al. . | |
| 3,494,490 | 2/1970 | Shell | 206/598 |
| 3,495,762 | 12/1970 | Verbic | 383/2 |
| 3,921,892 | 11/1975 | Macie . | |
| 3,944,070 | 3/1976 | Cardwell et al. . | |
| 4,165,024 | 8/1979 | Oswalt et al. . | |
| 4,270,677 | 6/1981 | Schmidt | 383/906 |
| 4,426,015 | 1/1984 | Preston et al. . | |
| 4,585,143 | 4/1986 | Fremow et al. . | |

FOREIGN PATENT DOCUMENTS

| | | | |
|---|---|---|---|
| 0680622 | 2/1964 | Canada | 108/55.1 |
| 0049974 | 4/1982 | European Pat. Off. . | |
| 0080839 | 6/1983 | European Pat. Off. . | |
| 2051026 | 10/1970 | Fed. Rep. of Germany . | |
| 2231575 | 12/1974 | France | 108/55.1 |
| 2475500 | 8/1981 | France | 206/599 |
| 105314 | 10/1985 | Norway . | |
| WO82/03371 | 10/1982 | PCT Int'l Appl. . | |
| 0354355 | 8/1931 | United Kingdom | 383/2 |
| 847036 | 9/1960 | United Kingdom . | |
| 1257297 | 12/1971 | United Kingdom . | |
| 1578312 | 1/1978 | United Kingdom . | |

OTHER PUBLICATIONS

Packaging 41, 350, Sep. 1959.

*Primary Examiner*—Jimmy G. Foster
*Attorney, Agent, or Firm*—Cushman, Darby & Cushman

[57] ABSTRACT

A flexible intermediate bulk container (1) is provided with a stabilizing cradle (2) having supporting members (4*a*, 4*b*) spaced to permit the container (1) to sag into the space between the supporting members (4*a*, 4*b*) to depth substantially equal to the height of the cradle (2).

9 Claims, 10 Drawing Sheets

INTERMEDIATE BULK CONTAINERS

This is a continuation of application Ser. No. 496,214, filed May 19, 1983, which was abandoned upon the filing hereof.

This invention relates to flexible intermediate bulk containers, which are hereinafter referred to as IBC's. Such containers, which are often in the form of bags or sacks fabricated from a woven fabric, e.g. woven from polyolefin fibres or ribbons, often with an impervious liner, e.g. as a separate inner plastics sack or having an inner or outer plastics laminated coating, are widely used for transporting powdery or granular materials, such as chemicals, e.g. fertilizers, when it is desired that a unit package should be of the order of 0.5 to 3 $m^3$. Typically IBC's have a capacity of 1 to 1.5 $m^3$.

Heretofore such IBC's have been provided with lifting straps or slings sewn or otherwise attached to the container or formed integrally therewith. When lifted by such means, the contents of the IBC are compressed and tend to give the IBC a convex top. This gives rise to problems when it is desired to stack the IBC's several high since the convex top tends to give rise to stack instability with consequent safety hazards. Also, since the IBC's are lifted from the top, it is often necessary for an operative to climb on to the top of the stack to attach the slings etc. to the lifting device.

In some cases the IBC's are transported on pallets of the conventional type, generally with one IBC per pallet, so that the palletised IBC can be moved by means of conventional fork-lift trucks. Formation of a convex top to the IBC, with consequent stacking instability is still liable to occur, particularly where the IBC is lifted by slings etc. on to the pallet.

We have devised a method of overcoming this problem. Accordingly we provide in combination (a) an IBC and (b) a supporting cradle therefor, said cradle comprising a pair of supporting members disposed beneath the base of the IBC so that the IBC can sag into the space between said supporting members to a depth substantially equal to the height of the cradle, said supporting members being connected so that the maximum spacing between said supporting members, and their height, is sufficient to permit the insertion of the tines of a fork-lift truck on either side of said supporting members and beneath said IBC.

Preferably the supporting members are provided with transverse members extending outwardly from the upper edges thereof so that the cradle can be lifted, together with the IBC, by a fork-lift truck having its tines disposed beneath said transverse members.

Figure 1:
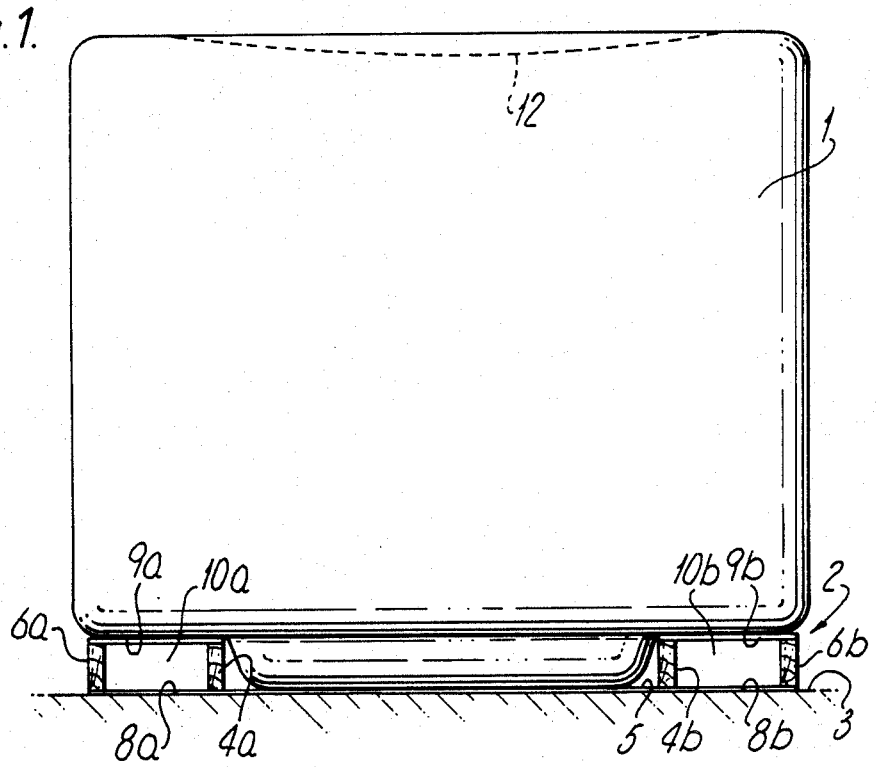
Figure 2:
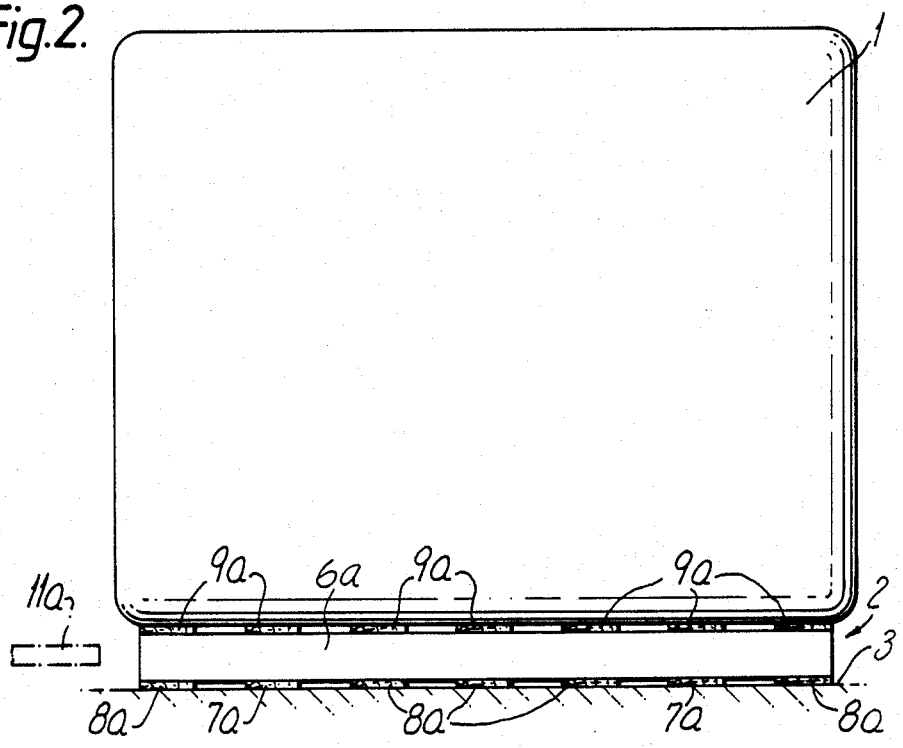
Figure 3:
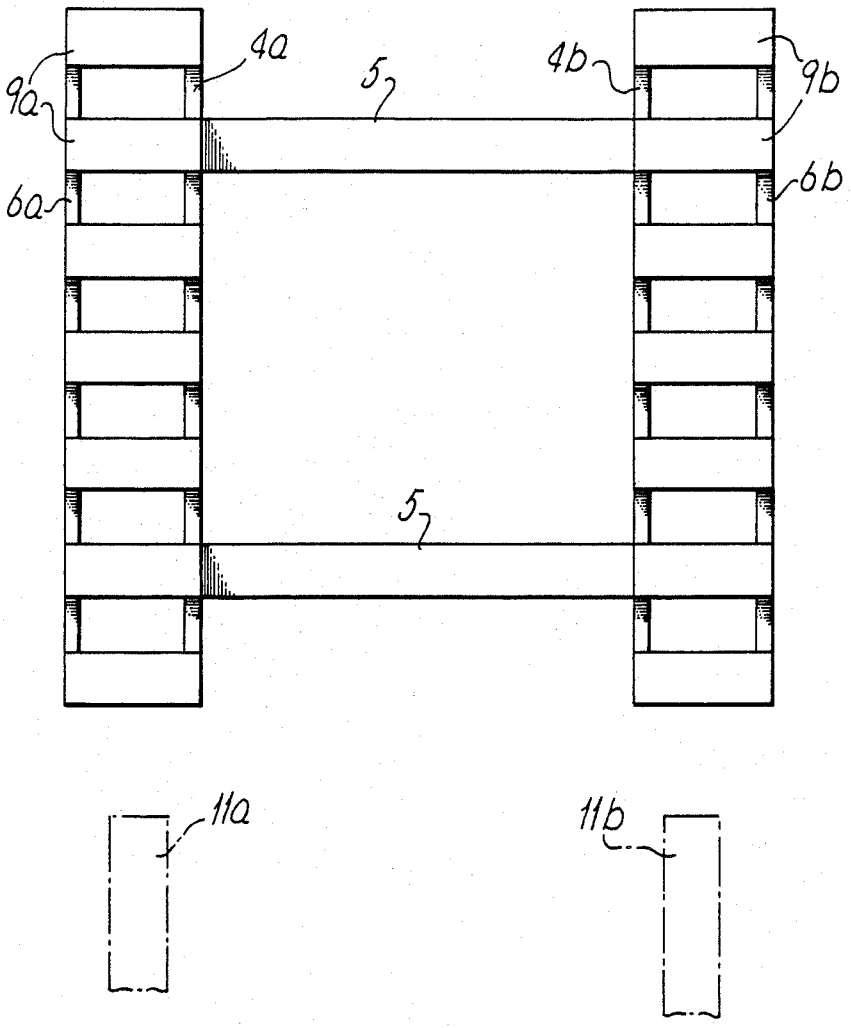
Figure 4:
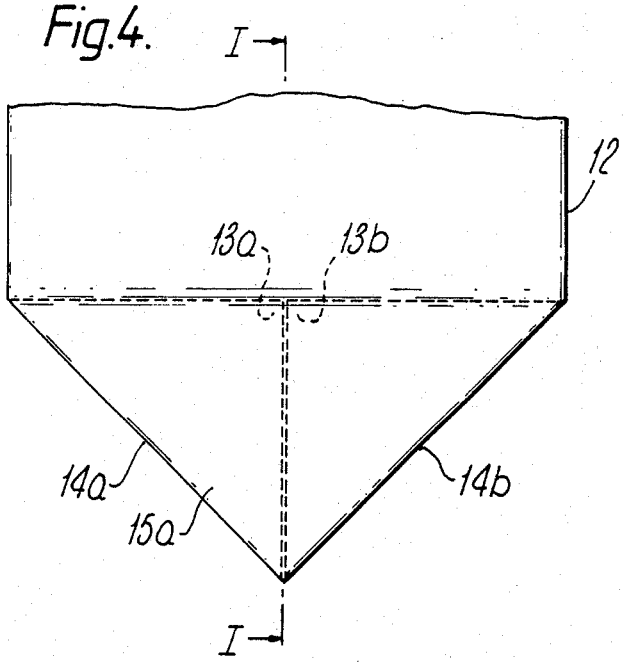
Figure 4A:
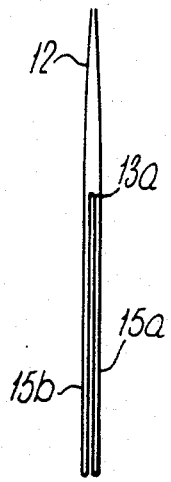
Figure 4B:
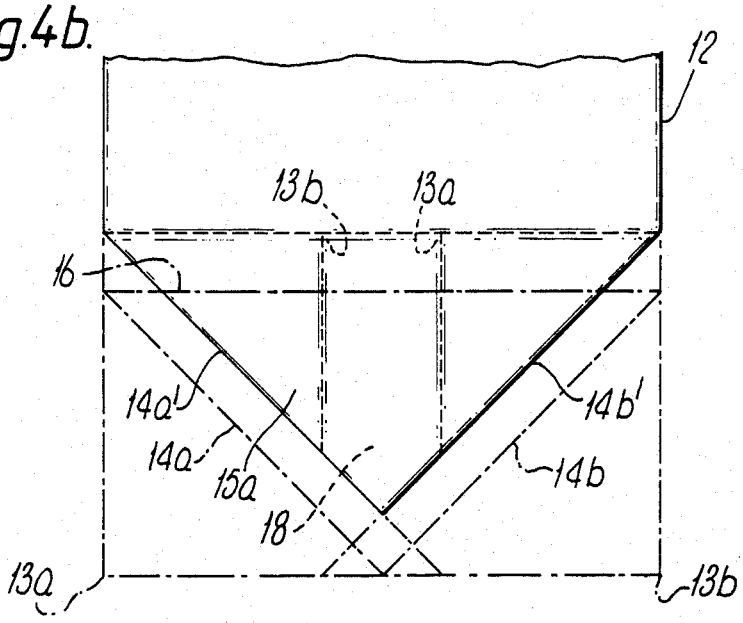
Figure 5:
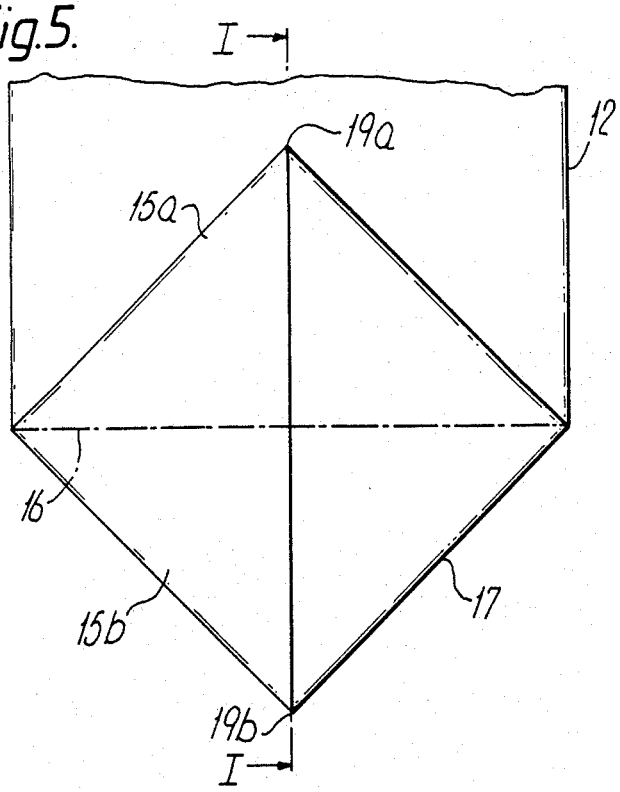
Figure 5A:
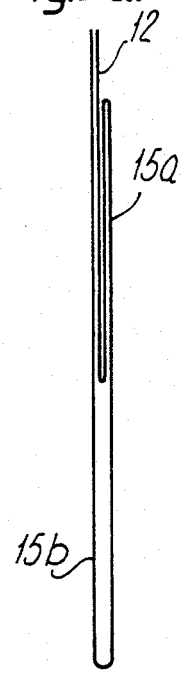
Figure 5B:
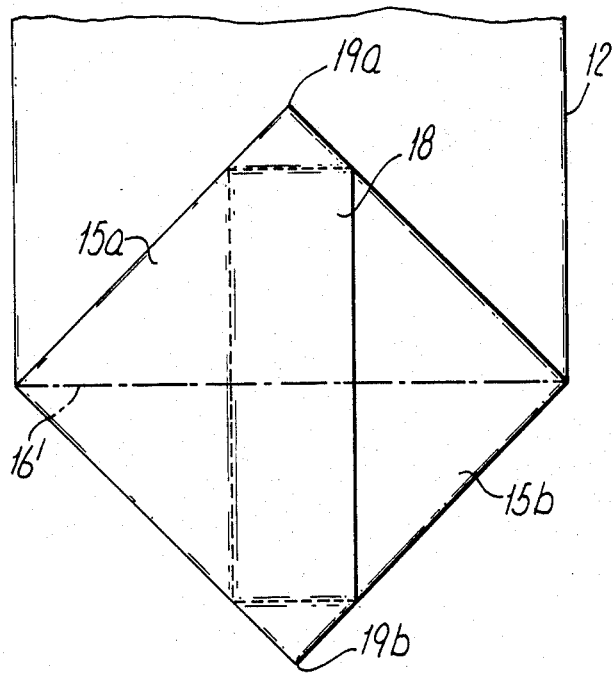

One embodiment of the invention is illustrated by the accompanying drawings wherein FIG. 1 is a front elevation of the IBC located on the cradle, FIG. 2 is a side elevation of the IBC located on the cradle, FIG. 3 is a plan of the cradle.

Figure 6:
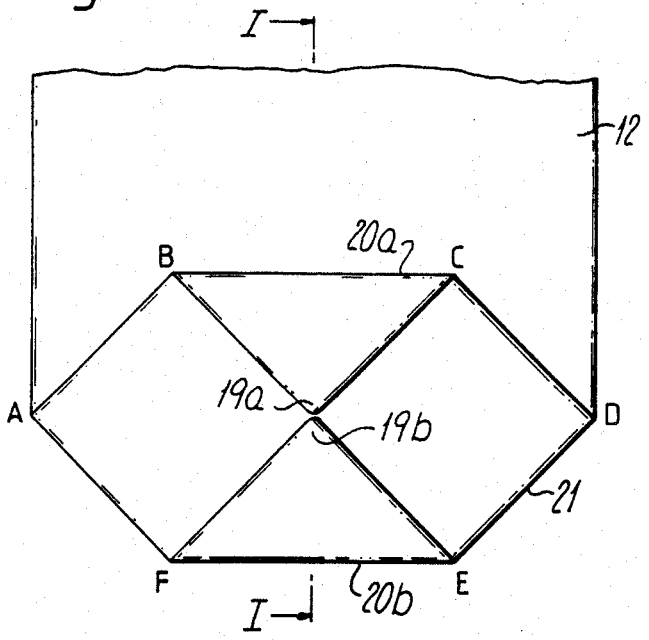
Figure 6A:
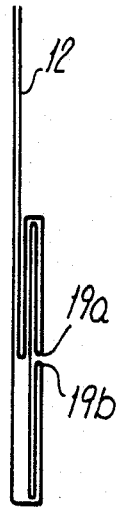
Figure 6B:
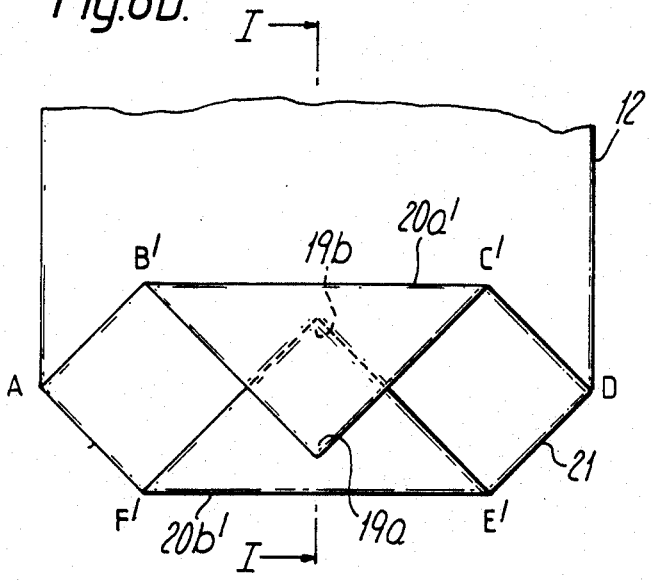
Figure 6C:
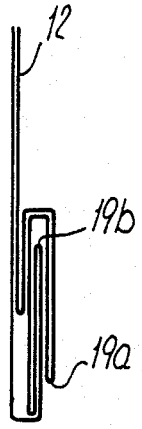
Figure 7:
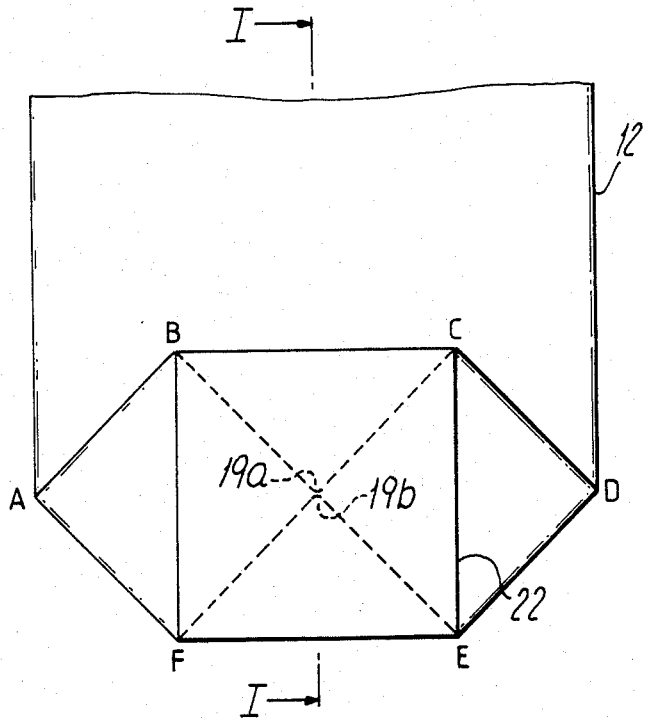
Figure 9:
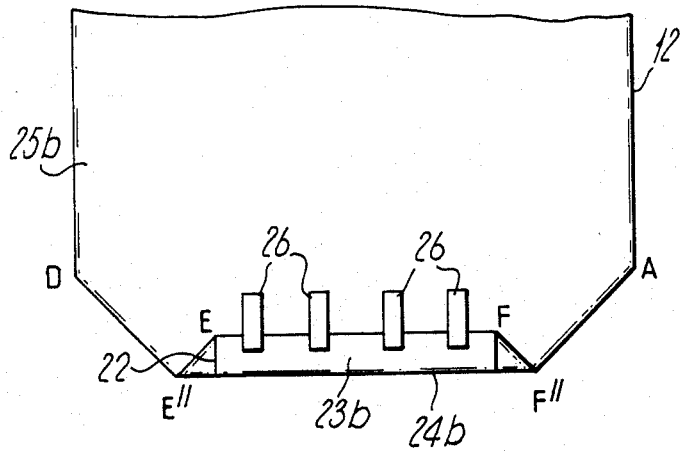
Figure 8A:
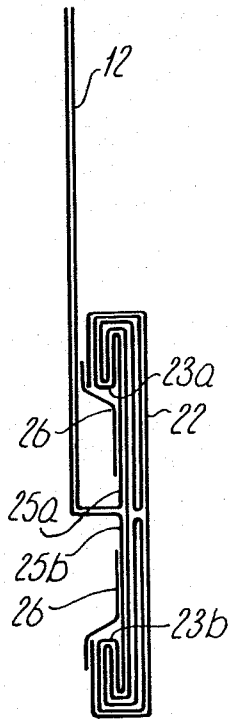
Figure 8:
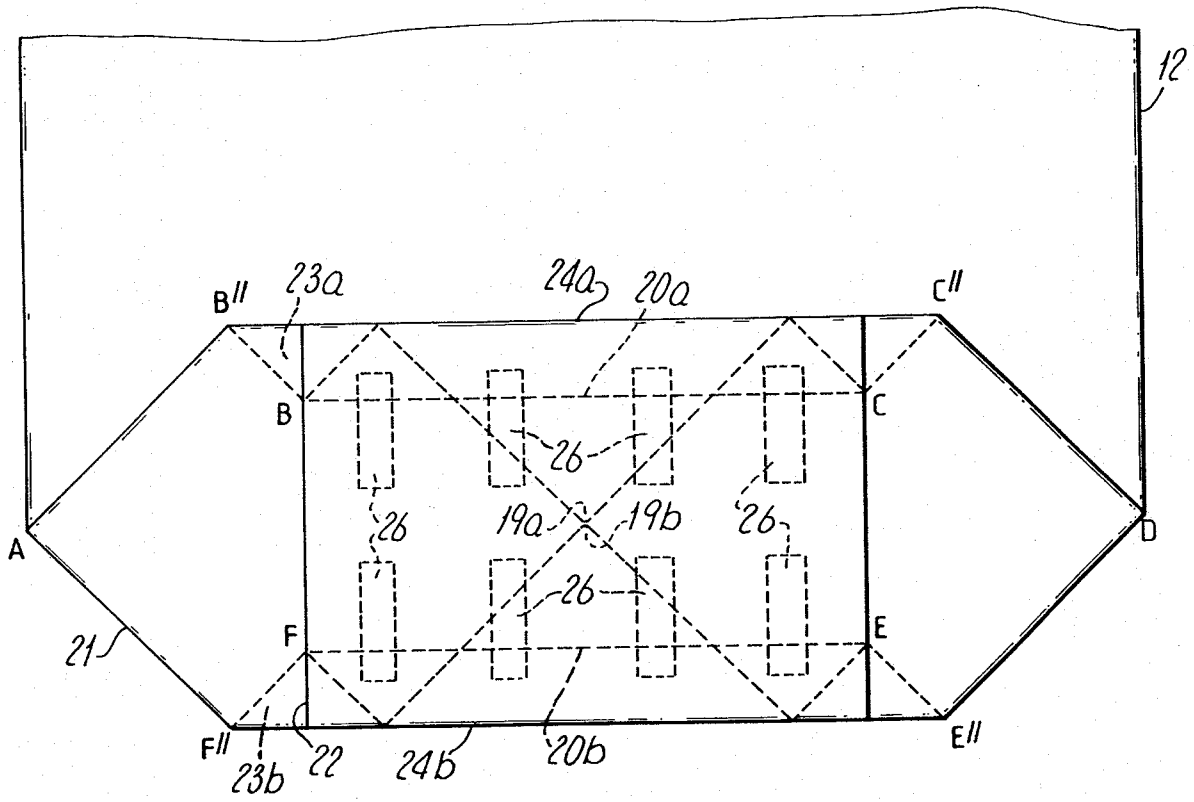

FIGS. 4 to 9 are diagrammatic elevations showing the stages in the formation of the bottom of an IBC suitable for use with the cradle. FIGS. 8 and 9 are front and back elevations respectively of the final stage.

FIGS. 4*a* to 8*a* show sections along the lines I—I of FIGS. 4 to 8 respectively.

FIGS. 4*b*, 5*b*, 6*b* and 6*c* correspond to FIGS. 4, 5, 6 and 6*a* respectively showing possible modifications.

Figure 10:
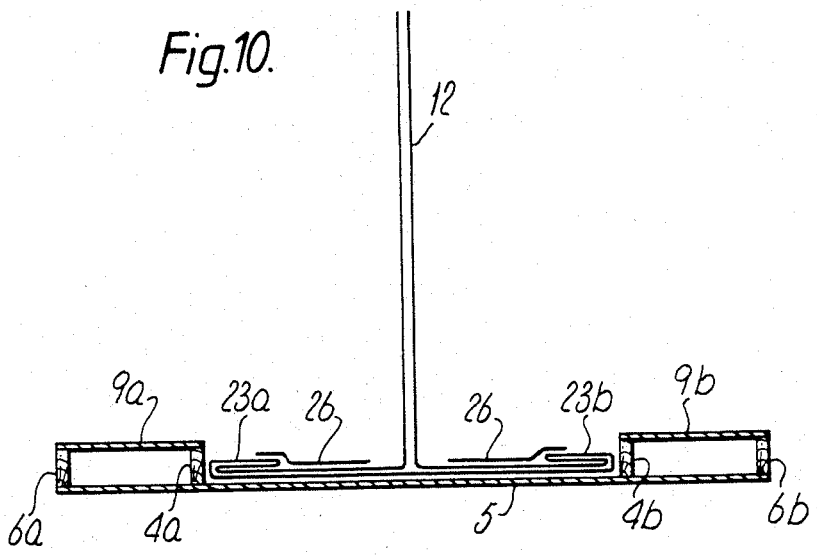
Figure 11:
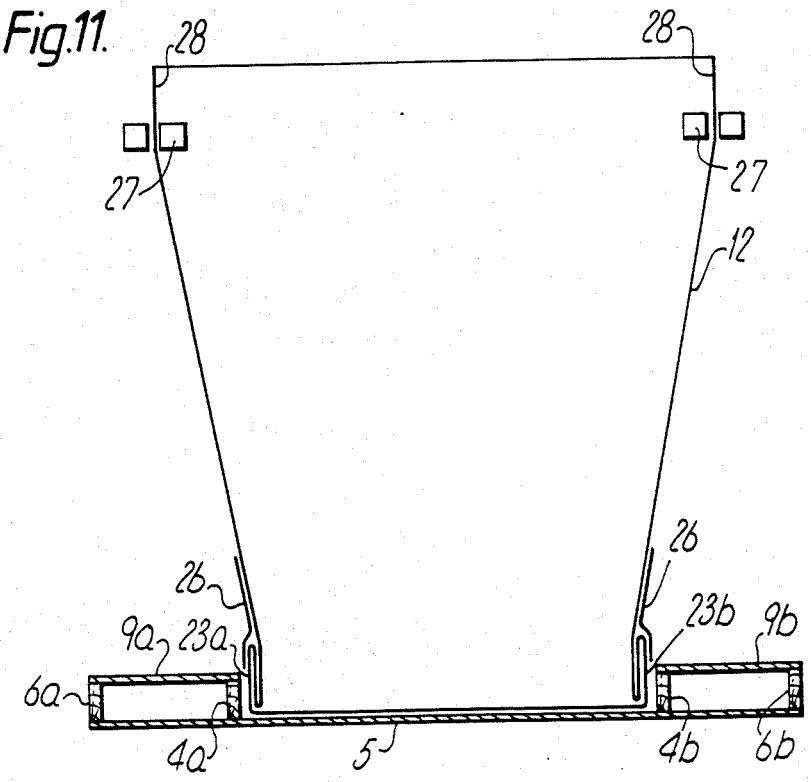
Figure 12:
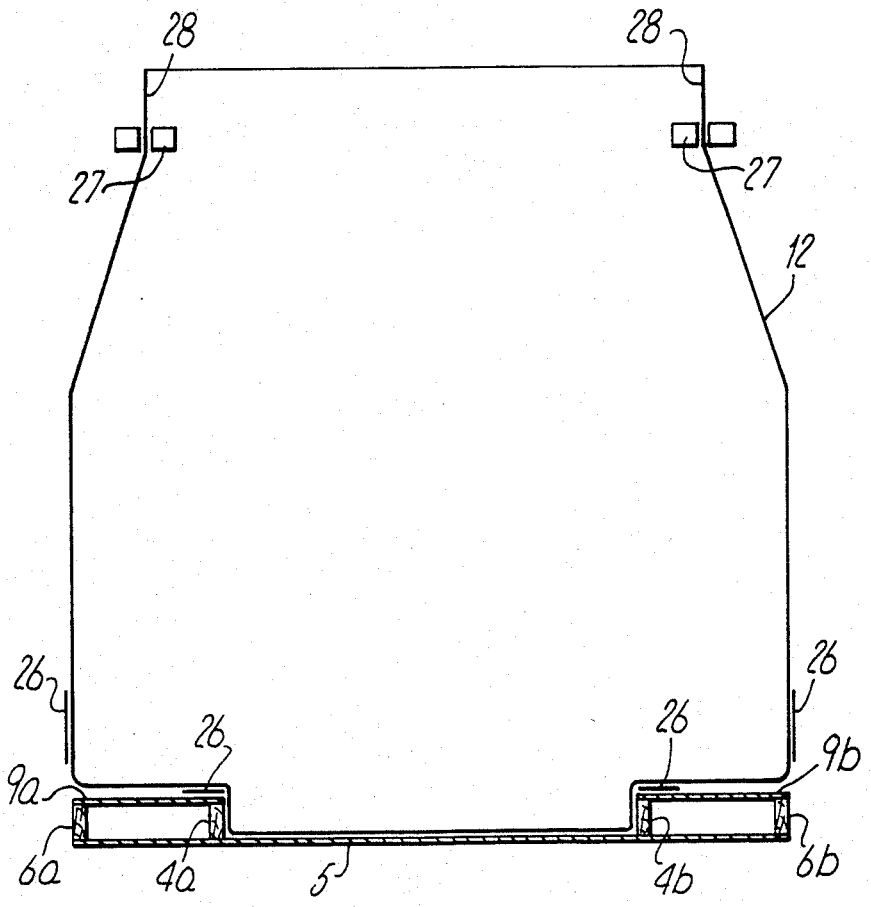

FIGS. 10 to 12 are sections through an IBC of the type shown in FIGS. 8 and 9 positioned in a cradle showing the various stages in filling. In FIGS. 10 to 12 some of the layers of material forming the base have been omitted for simplicity.

In FIGS. 4*a* to 8*a*, and 10 to 12, the component layers are shown separated slightly for clarity.

Figure 13:
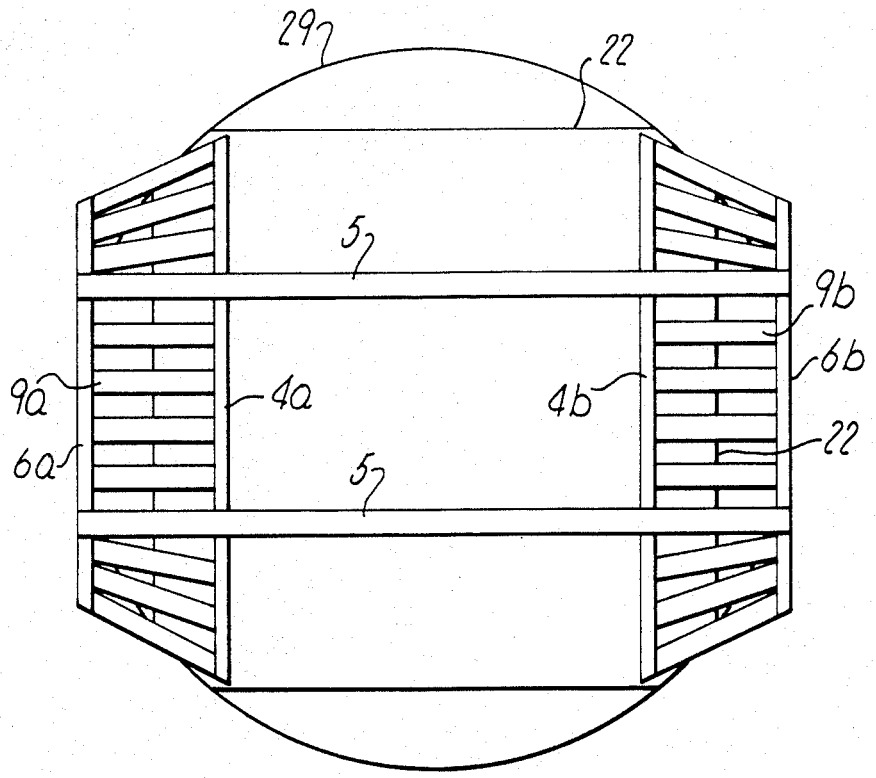

FIG. 13 is a view, from the underside, of a filled IBC as shown in FIG. 12 on a slightly modified cradle.

In FIGS. 1 and 2 an IBC 1, of approximate capacity 1 $m^3$ in the form of a nominal cuboid bag is located on a cradle 2 which is resting on a surface 3, which may be the ground or another IBC.

The cradle has a pair of supporting members 4*a*, 4*b* spaced apart only by a pair of cross members 5 connecting the lower edges of the supporting members 4*a*, 4*b*. A pair of auxiliary members 6*a*, 6*b* are provided, each being disposed outwardly of, and parallel to, the respective supporting members 4*a*, 4*b*. These auxiliary members 6*a*, 6*b* are connected to their respective supporting members 4*a*, 4*b* by extensions 7*a*, 7*b* of the cross-members 5 and by transverse members 8*a*, 8*b* at their lower edges, and by transverse members 9*a*, 9*b* at their upper edges.

The auxiliary members 6*a*, 6*b* and the support members 4*a*, 4*b*, together with the tranverse members 8*a*, 8*b*, 9*a*, 9*b*, associated therewith thus define box-like structures having open ends 10*a*, 10*b*.

The dimensions of the members is such that the tines 11*a*, 11*b* (shown dotted in FIGS. 2 and 3) of a fork-lift truck can be inserted into the box-like structures through their open ends 10*a*, 10*b*. The transverse members 9*a*, 9*b* above the supporting members 4*a*, 4*b* enable the cradle to be lifted, with the IBC, by the tines of a fork-lift truck inserted into the box-like structures.

Typically the dimension of the components are such that the openings 10*a*, 10*b* have a width of the order of 15–20 cm and a height of 5–8 cm, and are spaced apart by 70–85 cm. If the supporting members 4*a*, 4*b* have a thickness of about 2.5 cm, the distance between the facing sides of the supporting members 4*a*, 4*b* will thus be about 65–80 cm. If the transverse members 8*a*, 8*b*, 9*a*, 9*b*, and the cross-members 5*a*, 5*b* have a thickness of about 1 cm, the total height of the cradle will be about 7–10 cm.

Between the box-like structures there is thus a space of approximate width 65–80 cm and 7–10 cm height. The IBC sags into this space so that it rests upon the surface 3: hence the bulk of the weight (and of any IBC's stacked on top of IBC 1) is borne by the base of IBC 1 rather than by the cradle 2. In turn this sagging of the IBC may, in some cases, give the top of the IBC a slightly concave configuration as shown by the dotted line 12 in FIG. 1.

The IBC is preferably filled while located on the cradle as this enables the requisite degree of "sag" to be achieved and, by using conventional vibratory filling devices, the top of the IBC can then be rendered essentially flat. Where the IBC has an impermeable lining, it may be advantageous, after filling, to evacuate the air inside the lining. This renders the filled IBC relatively rigid.

While lifting straps can be fastened to the IBC or made integral therewith, preferably there are no such straps or lifting means so that the IBC can only be handled by means of the cradle so that the formation of a convex top to the IBC is avoided.

Where there are no lifting straps etc., the material of the IBC can be less substantial than is conventional, thus giving cost savings. Since the cradle serves essentially only a stabilising function, it too can be less substantial than conventional pallets. Conveniently the cradle is made from timber.

In order to enable the IBC to be filled while located on the cradle, it is desirable that means are provided to accurately position the empty IBC on the cradle so that, when filled, the IBC is evenly supported by the cradle.

The IBC is preferably of tubular configuration with its bottom formed, as in conventional bag or sack technology by folding and sealing the material at one end of the tube. Depending on the materials employed for the manufacture of the IBC, the bottom may be sealed by stitching, by an adhesive, and/or by welding, and may incorporate a reinforcing or sealing patch. Conveniently the bottom is formed by folding one end of the tube, while the latter is in the collapsed, "lay-flat" state, into an approximately square configuration, followed by folding the opposite "free" corners of the square towards one another to form a generally hexagonal shape having a length equal to the lay-flat width of the tube and four sides of equal length disposed in two opposite pairs with a right angle between adjacent equal length sides. The other two sides of the hexagon will not be disposed at right angles to adjacent sides but may, in some cases, also have a length equal to those of the aforesaid four sides.

By forming the bottom of the IBC of such a size that it has a hexagonal configuration so that the hexagon has a length equal to the lay-flat width of the tube, parallel opposed sides, one pair of opposed sides parallel to the length of the hexagon, and a width such that the hexagon can fit between the support numbers of the cradle with the sides of the hexagon parallel to its length parallel to the support members, the IBC can be accurately positioned during filling. Accordingly, the present invention also provides an IBC suitable for use in a combination as hereinbefore described comprising a flexible tubular body having a closed bottom which has, when said tubular body is in the collapsed, "lay-flat", condition, a generally hexagonal configuration, said hexagon having a length equal to the lay-flat width of said body, parallel opposed sides, one pair of opposed sides parallel to the length of the hexagon and a width such that the hexagon can fit between the support members of the cradle with the sides of the hexagon parallel to its length parallel to said support members.

However, for optimum capacity, appearance, and stability of the filled IBC, the bottom of the IBC is preferably of such a hexagonal configuration with the width of the hexagon equal to the length of the sides of the hexagon that are parallel to its length.

In many cases this width will exceed the spacing between the support members of the cradle.

We have found however that if portions of the bottom of the IBC are folded back, along lines parallel to the length of the hexagon, to give a bottom of width suitable to fit between the support members of the cradle, and the folded back portions lightly fastened to the sides of the IBC, on filling the IBC, the fastening can be broken to release these folded back portions.

The light fastening may be, for example, stitching with a suitable thread, and/or a layer, line, or spots of an adhesive, and/or one or more strips of adhesive tape.

In order to obtain satisfactory filling of the container and release of the folded back portions, it is preferred to clamp the top of the IBC during the filling operation.

We therefore also provide an IBC as described above wherein the hexagonal bottom has a width greater than the spacing between the support members of the cradle, and portions of said bottom are folded back, along lines parallel to the length of the hexagon, to give a narrower hexagon of width such that the narrower hexagon can fit between the support members of the cradle with the sides of the narrower hexagon parallel to its length parallel to said support members, said folded back portions being releasably fastened to the sides of the tubular body.

As mentioned above, the cradle is dimensioned so that the tines of a fork-lift truck can be inserted in the openings 10*a*, 10*b*, and to this end, the overall width of the space between the support members 4*a*, 4*b* is about 70 cm while the overall width of the cradle is about 120 cm.

Such a cradle can conveniently support an IBC which, when filled is of approximate cylindrical configuration having a diameter of about 120 cm. Such an IBC can be formed from a tube of lay-flat width of about 188 cm.

The bottom of the IBC can be formed, as shown in FIGS. 4 to 9 and 4*a* to 8*a*, by folding the lay-flat tube 12. First the bottom corners 13*a*, 13*b* are folded, about lines 14*a* 14*b* respectively and tucked inside the tube (see FIGS. 4 and 4*a*). Two triangular shaped flaps 15*a*, 15*b* are thus formed at the end of the tube. One flap 15*a* is then folded upwards about line 16 (shown dotted in FIG. 5) to give a square configuration 17.

It will be appreciated that, if desired, the lines along which the corners 13*a*, 13*b* and flap 15*a* are folded may be displaced to 14*a*', 14*b*', and 16' respectively (see FIG. 4*b*) so that an overlap 18 (see FIG. 5*b*) is formed.

The free opposed corners 19*a*, 19*b* of square 17 are then folded towards each other (see FIGS. 6, 6*a*) about lines 20*a*, 20*b* to give a hexagonal configuration 21 denoted in FIG. 6 as hexagon ABCDEF. This hexagon has opposed parallel sides AB, ED; BC, FE; and CD, AF and four sides AB, CD, DE, and FA of equal length.

Figure 7A:
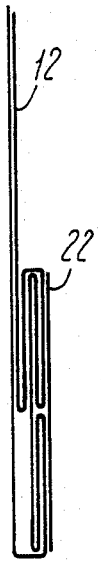

A reinforcing patch 22 is then applied to the area BCEF (see FIGS. 7, 7*a*).

By geometry it is seen that if the opposed corners 19*a*, 19*b* are folded so that they just meet, corners BCEF of the hexagon describe a square. Then, if the lay-flat width of the tube 12 is 188 cm, the width of the hexagon 21, i.e. the distance between the opposed parallel sides BC and FE, is 94 cm, which is in an excess of the spacing (about 70 cm) between the support members 4*a*, 4*b* of the cradle. The distance between sides BC and FE can be reduced by folding the opposed corners 19*a*, 19*b* of square 17 along lines 20*a*', 20*b*' (see FIG. 6*b*) so that the corners 19*a*, 19*b* overlap, to give a narrower hexagon AB'C'DE'F' that could fit between the support members 4*a*, 4*b* of the cradle. While such an arrangement could be utilised, the corners B'C'E'F' of the narrower hexagon AB'C'DE'F' no longer describe a square.

A square base BCEF is desirable in order to give the IBC is optimum capacity and to improve the appearance and stability of the filled IBC on the cradle.

In order to permit the bottom to fit between the support members 4*a*, 4*b* of the cradle and, at the same time, permit the IBC in use to have a square bare BCEF, we therefore prefer that opposed portions 23*a*, 23*b* of the hexagon 21 (each portion containing one of the opposed sides BC, EF of the hexagon) are folded back, about lines 24*a*, 24*b* (see FIG. 8, 8*a*, 9) to give a narrower hexagon AB″C″DE″F″ of size such that it can fit between the support members 4*a*, 4*b* of the cradle with sides B″C″ and E″F″ parallel to the length AD of the hexagon and parallel to the support members 4*a*, 4*b*.

These folded back portions 23*a*, 23*b* are fastened to the outer sides 25*a*, 25*b* of the rest of the flaps 15*a*, 15*b* by means of a releasable fastening, e.g. by means of adhesive tape strips 26 (see FIGS. 8, 8*a*, and 9) and/or by a line or spots of a weak adhesive (not shown).

In use the IBC is first placed (see FIG. 10) on the cradle with the narrow hexagon AB″C″DE″F″ between the support members 4*a*, 4*b* with the sides B″C″ and F″E″ parallel to the support members 4*a*, 4*b*.

The top of the IBC is then clamped open by a clamp device 27 (see FIG. 11). On filling the IBC (see FIG. 12) the fastening, e.g. tape 26, holding portions 23*a*, 23*b* back is broken by the action of the IBC base opening out to accommodate the contents (which are not shown in FIG. 12).

After filling, the clamp 27 is released and the top of the IBC closed, for example by folding and sealing the upper ends 28 of the IBC over the contents and/or by the application of a separate cover member (not shown) which is fastened to the top of the IBC, e.g. by shrink wrapping.

Where the filled IBC 29 is of generally cylindrical configuration, i.e. as is obtained using an IBC made, as described above, from a tubular material, the cradle is preferably of octagonal configuration as shown in FIG. 13.

I claim:

1. A packaging combination for resting on a surface comprising (a) a flexible intermediate bulk container filled in bulk with powder or granular material and having a base with an inner portion and two outer portions, one on either side of said inner portion; and (b) a cradle, disposed beneath said container, comprising (i) a pair of spaced apart support members disposed beneath the base of said container such that each support member supports an outer portion of said container base, said support members being spaced apart, and of such height and thickness, that, when the combination is resting on a surface, the tines of a fork-lift truck can be inserted between said container base and said surface, with the tines outside the support members and with one tine beneath each outer base portion, thereby enabling said container to be lifted from said surface by said fork-lift truck tines; and (ii) spaced apart cross members holding said support members spaced apart such that said inner portion of the container base sags into the space between said support members and between said cross members, said support and cross members being spaced apart to such an extent such that, when the combination is resting on said surface, at least part of said sagging inner portion of the container base contacts said surface whereby the majority of the weight of the material contained in said container is supported through the contact of the surface with that sagging part of the container base.

2. A combination according to claim 1 characterised in that the support members are provided with transverse members extending outwardly from the upper edges thereof so that the cradle can be lifted, together with the container, by a fork-lift truck having its tines disposed beneath said transverse members.

3. A combination according to claim 1 characterised in that each support members of the cradle is provided with an auxiliary member disposed outwardly of, and parallel to, and held in spaced relationship with, its associated support member.

4. A combination according to claim 3 characterised in that each support member, its associated auxiliary member and the means holding them in spaced relationship, define an open-ended box-like structure of such dimensions that the cradle can be lifted by fork-lift truck having its tines inserted into said box-like structures through the open ends thereof.

5. A combination according to claim 1 characterised in that the support members are connected together only at their lower edges by said cross members.

6. A combination according to claim 1 wherein the bulk container has a capacity of 0.5 to 3 $m^3$.

7. A combination according to claim 1 wherein the container (a) has a tubular body with a closed bottom and (b) is formed by opening out a lay-flat bag having a closed end having, in the lay-flat condition, the configuration of a hexagon having (I) a length equal to the lay-flat width of said body and (II) parallel opposed sides with one pair of opposed sides parallel to the length of said hexagon, the dimensions of said hexagon in relation to the spacing between the support members of the cradle being such that said closed end of the bag in the lay-flat condition can fit between said support members with the sides of said hexagon that are parallel to its length parallel to said support members.

8. A combination according to claim 1 wherein the container (a) has a tubular body with a closed bottom and (b) is formed by opening out a lay-flat by having a closed end having, in the lay-flat condition, the configuration of a first hexagon having (I) a length equal to the lay-flat width of said body and (II) parallel opposed sides with one pair of opposed sides parallel to the length of said first hexagon, said bag in the lay-flat condition having portions of said closed end (1) folded back along lines parallel to the length of said first hexagon to provide a second, narrower, hexagon, and (2) releasably fastened to the sides of said tubular body, the dimensions of said first and second hexagons in relation to the spacing between the support members of the cradle being such that the distance between said support members is (i) less than the distance between said opposed sides of said first hexagon that are parallel to the length of said first hexagon, and (ii) greater than the distance between the opposed sides of said second hexagon that are parallel to the length of the second hexagon, thereby enabling the closed end of the bag in the lay-flat conditions with said portions releasably fastened to the sides of the tubular body to fit between said support members with said sides of said second hexagon that are parallel to its length parallel to said support members.

9. A combination according to claim 8 characterised in that in said first hexagon the ends of the sides parallel to the length of the hexagon define the corners of a square.

* * * * *

UNITED STATES PATENT AND TRADEMARK OFFICE

CERTIFICATE OF CORRECTION

PATENT NO. : 4,830,191

DATED : May 16, 1989

INVENTOR(S) : DIJKSMAN, Alan M.

It is certified that error appears in the above-identified patent and that said Letters Patent is hereby corrected as shown below:

On the title page, item [30], line 2, insert --8135731-- and delete "8135431".

Signed and Sealed this

Twenty-fourth Day of July, 1990

*Attest:*

HARRY F. MANBECK, JR.

*Attesting Officer*

*Commissioner of Patents and Trademarks*